US009208771B2

(12) United States Patent
Zhou et al.

(10) Patent No.: US 9,208,771 B2
(45) Date of Patent: Dec. 8, 2015

(54) AMBIENT NOISE-BASED ADAPTATION OF SECONDARY PATH ADAPTIVE RESPONSE IN NOISE-CANCELING PERSONAL AUDIO DEVICES

(71) Applicant: Cirrus Logic, Inc., Austin, TX (US)

(72) Inventors: Dayong Zhou, Austin, TX (US); Yang Lu, Austin, TX (US); Jon D. Hendrix, Wimberly, TX (US); Jeffrey Alderson, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 188 days.

(21) Appl. No.: 14/062,951

(22) Filed: Oct. 25, 2013

(65) Prior Publication Data

US 2014/0270224 A1 Sep. 18, 2014

Related U.S. Application Data

(60) Provisional application No. 61/787,641, filed on Mar. 15, 2013.

(51) Int. Cl.
*G10K 11/178* (2006.01)

(52) U.S. Cl.
CPC ..... *G10K 11/178* (2013.01); *G10K 2210/1081* (2013.01); *G10K 2210/3016* (2013.01); *G10K 2210/3022* (2013.01); *G10K 2210/3026* (2013.01); *G10K 2210/3028* (2013.01)

(58) Field of Classification Search
None
See application file for complete search history.

(56) References Cited

U.S. PATENT DOCUMENTS 5,251,263 A 10/1993 Andrea et al.
5,278,913 A 1/1994 Delfosse et al.
5,321,759 A 6/1994 Yuan (Continued)

FOREIGN PATENT DOCUMENTS

DE 102011013343 A1 9/2012
EP 1880699 A2 1/2008

(Continued)

OTHER PUBLICATIONS

U.S. Appl. No. 14/656,124, filed Mar. 12, 2015, Hendrix, et al.

(Continued)

*Primary Examiner* — Brenda Bernardi
(74) *Attorney, Agent, or Firm* — Mitch Harris, Atty at Law, LLC; Andrew M. Harris

(57) ABSTRACT

An adaptive noise canceller adapts a secondary path modeling response using ambient noise, rather than using another noise source or source audio as a training source. Anti-noise generated from a reference microphone signal using a first adaptive filter is used as the training signal for training the secondary path response. Ambient noise at the error microphone is removed from an error microphone signal, so that only anti-noise remains. A primary path modeling adaptive filter is used to modify the reference microphone signal to generate a source of ambient noise that is correlated with the ambient noise present at the error microphone, which is then subtracted from the error microphone signal to generate the error signal. The primary path modeling adaptive filter is previously adapted by minimizing components of the error microphone signal appearing in an output of the primary path adaptive filter while the anti-noise signal is muted.

24 Claims, 5 Drawing Sheets

(56) References Cited

U.S. PATENT DOCUMENTS 5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
5,465,413 A 11/1995 Enge et al.
5,548,681 A 8/1996 Gleaves et al.
5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,680,456 B2 3/2010 Muhammad et al.
7,742,790 B2 6/2010 Konchitsky et al.
7,817,808 B2 10/2010 Konchitsky et al.
8,019,050 B2 9/2011 Mactavish et al.
8,249,262 B2 8/2012 Chua et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
8,804,974 B1 8/2014 Melanson
8,908,877 B2 12/2014 Abdollahzadeh Milani et al.
8,948,410 B2 * 2/2015 Van Leest ..... 381/71.8
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0055910 A1 3/2006 Lee
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Wessling et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 6/2012 Nicholson et al.
2012/0140942 A1 6/2012 Loeda

(56) References Cited

U.S. PATENT DOCUMENTS

| | | | |
|---|---|---|---|
| 2012/0140943 | A1 | 6/2012 | Hendrix et al. |
| 2012/0148062 | A1 | 6/2012 | Scarlett et al. |
| 2012/0155666 | A1 | 6/2012 | Nair |
| 2012/0170766 | A1 | 7/2012 | Alves et al. |
| 2012/0207317 | A1 | 8/2012 | Abdollahzadeh Milani et al. |
| 2012/0215519 | A1 | 8/2012 | Park et al. |
| 2012/0250873 | A1 | 10/2012 | Bakalos et al. |
| 2012/0259626 | A1 | 10/2012 | Li et al. |
| 2012/0263317 | A1 | 10/2012 | Shin et al. |
| 2012/0300958 | A1 | 11/2012 | Klemmensen |
| 2012/0300960 | A1 | 11/2012 | Mackay et al. |
| 2012/0308021 | A1 | 12/2012 | Kwatra et al. |
| 2012/0308024 | A1 | 12/2012 | Alderson et al. |
| 2012/0308025 | A1 | 12/2012 | Hendrix et al. |
| 2012/0308026 | A1 | 12/2012 | Kamath et al. |
| 2012/0308027 | A1 | 12/2012 | Kwatra |
| 2012/0308028 | A1 | 12/2012 | Kwatra et al. |
| 2012/0310640 | A1 | 12/2012 | Kwatra et al. |
| 2013/0010982 | A1 | 1/2013 | Elko et al. |
| 2013/0083939 | A1 | 4/2013 | Fellers et al. |
| 2013/0243198 | A1 | 9/2013 | Van Rumpt |
| 2013/0243225 | A1 | 9/2013 | Yokota |
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson et al. |
| 2013/0343556 | A1 | 12/2013 | Bright |
| 2013/0343571 | A1 | 12/2013 | Rayala et al. |
| 2014/0044275 | A1 | 2/2014 | Goldstein et al. |
| 2014/0050332 | A1 | 2/2014 | Nielsen et al. |
| 2014/0072134 | A1 | 3/2014 | Po et al. |
| 2014/0086425 | A1 | 3/2014 | Jensen et al. |
| 2014/0177851 | A1 | 6/2014 | Kitazawa et al. |
| 2014/0211953 | A1 | 7/2014 | Alderson et al. |
| 2014/0270222 | A1 | 9/2014 | Hendrix et al. |
| 2014/0270223 | A1 | 9/2014 | Li et al. |
| 2015/0092953 | A1 | 4/2015 | Abdollahzadeh Milani et al. |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2010 |
| EP | 2237573 | A1 | 10/2010 |
| EP | 2395500 | A1 | 12/2011 |
| EP | 2395501 | A1 | 12/2011 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06-186985 | A | 7/1994 |
| WO | WO 9911045 | | 3/1999 |
| WO | WO 03/015074 | A1 | 2/2003 |
| WO | WO 03015275 | A1 | 2/2003 |
| WO | WO 2004009007 | A1 | 1/2004 |
| WO | WO 2004017303 | A1 | 2/2004 |
| WO | WO 2007007916 | A1 | 1/2007 |
| WO | WO 2007113487 | A1 | 11/2007 |
| WO | WO 2010117714 | A1 | 10/2010 |
| WO | WO 2012134874 | A1 | 10/2012 |
| WO | WO 2015038255 | A1 | 3/2015 |

OTHER PUBLICATIONS

U.S. Appl. No. 14/029,159, filed Sep. 17, 2013, Li, et al.
U.S. Appl. No. 14/228,322, filed Mar. 28, 2014, Alderson, et al.
U.S. Appl. No. 13/762,504, filed Feb. 8, 2013, Abdollahzadeh Milani, et al.
U.S. Appl. No. 13/721,832, filed Dec. 20, 2012, Lu, et al.
U.S. Appl. No. 13/724,656, filed Dec. 21, 2012, Lu, et al.
U.S. Appl. No. 14/252,235, filed Apr. 14, 2014, Lu, et al.
U.S. Appl. No. 13/968,013, filed Aug. 15, 2013, Abdollahzadeh Milani, et al.
U.S. Appl. No. 13/924,935, filed Jun. 24, 2013, Hellman.
U.S. Appl. No. 13/896,526, filed May 17, 2013, Naderi.
U.S. Appl. No. 14/101,955, filed Dec. 10, 2013, Alderson.
U.S. Appl. No. 14/101,777, filed Dec. 10, 2013, Alderson et al.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. On Circuits and Systems, May 10-13, 1992, vol. 3, pp. 1179-1182, San Diego, CA.
Parkins, et al., "Narrowband and broadband active control in an enclosure using the acoustic energy density", J. Acoust. Soc. Am. Jul. 2000, pp. 192-203, vol. 108, issue 1, US.
Feng, et al.., "A broadband self-tuning active noise equaliser", Signal Processing, Oct. 1, 1997, pp. 251-256, vol. 62, No. 2, Elsevier Science Publishers B.V. Amsterdam, NL.
Zhang, et al., "A Robust Online Secondary Path Modeling Method with Auxiliary Noise Power Scheduling Strategy and Norm Constraint Manipulation", IEEE Transactions on Speech and Audio Processing, IEEE Service Center, Jan. 1, 2003, pp. 45-53, vol. 11, No. 1, NY.
Lopez-Gaudana, et al., "A hybrid active noise cancelling with secondary path modeling", 51st Midwest Symposium on Circuits and Systems, MWSCAS 2008, Aug. 10-13, 2008, pp. 277-280, IEEE, Knoxville, TN.
International Search Report and Written Opinion in PCT/US2014/017962, mailed on Jun. 10, 2014, 12 pages. (pp. 1-12 in pdf).
U.S. Appl. No. 14/578,567, filed Dec. 22, 2014, Kwatra, et al.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
U.S. Appl. No. 13/686,353, filed Nov. 27, 2012, Hendrix, et al.

(56) References Cited

OTHER PUBLICATIONS

U.S. Appl. No. 13/795,160, filed Mar. 12, 2013, Hendrix, et al.
U.S. Appl. No. 13/692,367, filed Dec. 3, 2012, Alderson, et al.
U.S. Appl. No. 13/722,119, filed Dec. 20, 2012, Hendrix, et al.
U.S. Appl. No. 13/727,718, filed Dec. 27, 2012, Alderson, et al.
U.S. Appl. No. 13/729,141, filed Dec. 28, 2012, Zhou, et al.
U.S. Appl. No. 13/784,018, filed Mar. 4, 2013, Alderson, et al.
U.S. Appl. No. 13/787,906, filed Mar. 7, 2013, Alderson, et al.
U.S. Appl. No. 13/794,931, filed Mar. 12, 2013, Lu et al.
U.S. Appl. No. 13/794,979, filed Mar. 12, 2013, Alderson, et al.
U.S. Appl. No. 13/968,007, filed Aug. 15, 2013, Hendrix, et al.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
U.S. Appl. No. 14/197,814, filed Mar. 5, 2014, Kaller, et al.
U.S. Appl. No. 14/210,537, filed Mar. 14, 2014, Abdollahzadeh Milani, et al.
U.S. Appl. No. 14/210,589, filed Mar. 14, 2014, Abdollahzadeh Milani, et al.
Lane, et al., "Voice Level: Autophonic Scale, Perceived Loudness, and the Effects of Sidetone",The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", Plos One, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
U.S. Appl. No. 14/734,321, filed Jun. 9, 2015, Alderson, et al.

* cited by examiner

AMBIENT NOISE-BASED ADAPTATION OF SECONDARY PATH ADAPTIVE RESPONSE IN NOISE-CANCELING PERSONAL AUDIO DEVICES

This U.S. patent application claims priority under 35 U.S.C. 119(e) to U.S. Provisional Patent Application Ser. No. 61/787,641 filed on Mar. 15, 2013.

BACKGROUND OF THE INVENTION

1. Field of the Invention

The present invention relates generally to personal audio devices such as headphones that include adaptive noise cancellation (ANC), and, more specifically, to architectural features of an ANC system in which a secondary path estimating response is trained using ambient noise.

2. Background of the Invention

Wireless telephones, such as mobile/cellular telephones, cordless telephones, and other consumer audio devices, such as MP3 players, are in widespread use. Performance of such devices with respect to intelligibility can be improved by providing noise canceling using a reference microphone to measure ambient acoustic events and then using signal processing to insert an anti-noise signal into the output of the device to cancel the ambient acoustic events.

Noise canceling operation can be improved by measuring the transducer output of a device at the transducer to determine the effectiveness of the noise canceling using an error microphone. The measured output of the transducer is ideally the source audio, e.g., downlink audio in a telephone and/or playback audio in either a dedicated audio player or a telephone, since the noise canceling signal(s) are ideally canceled by the ambient noise at the location of the transducer. To remove the source audio from the error microphone signal, the secondary path from the transducer through the error microphone can be estimated and used to filter the source audio to the correct phase and amplitude for subtraction from the error microphone signal. However, when source audio is absent, the secondary path estimate cannot typically be updated. In particular, at the beginning of a telephone conversation, the secondary path estimate may be incorrect and there is no source audio available for training the secondary path estimate until downlink speech commences.

Therefore, it would be desirable to provide a personal audio device, including wireless telephones, that provides noise cancellation using a secondary path estimate to measure the output of the transducer and that can adapt the secondary path estimate independent of whether source audio of sufficient amplitude is present.

SUMMARY OF THE INVENTION

The above-stated objective of providing a personal audio device providing noise cancelling including a secondary path estimate that can be adapted whether or not source audio has been present, is accomplished in a personal audio device, a method of operation, and an integrated circuit.

The personal audio device includes a housing, with a transducer mounted on the housing for reproducing an audio signal that includes both source audio for plackback to a listener and an anti-noise signal for countering the effects of ambient audio sounds in an acoustic output of the transducer. An error microphone is mounted on the housing to provide an error microphone signal indicative of the transducer output and the ambient audio sounds. The personal audio device further includes an adaptive noise-canceling (ANC) processing circuit within the housing for adaptively generating an anti-noise signal from the error microphone signal such that the anti-noise signal causes substantial cancellation of the ambient audio sounds. The processing circuit controls adaptation of a secondary path adaptive filter for compensating for the electro-acoustical path from the output of the processing circuit through the transducer, wherein the processing circuit removes source audio as shaped by the secondary path response from the error microphone signal to provide an error signal. The processing circuit provides ambient noise to the secondary path adaptive filter's coefficient control circuit as a training signal for adapting the secondary path response. The ambient noise provided to the coefficient control circuit may be the anti-noise signal generated from the reference microphone signal, and the ambient noise present at the error microphone removed from the error microphone signal using a primary path modeling adaptive filter to generate an error signal that contains only the components of the error microphone signal due to the anti-noise reproduced by the transducer. The response of the primary path modeling adaptive filter is earlier adapted using the error microphone signal and the reference microphone signal, so that components of the error microphone signal appearing in an output of the primary path adaptive filter are minimized.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present disclosure reveals noise canceling techniques and circuits that can be implemented in a personal audio device, such as a wireless telephone. The personal audio device includes an adaptive noise canceling (ANC) circuit that measures the ambient acoustic environment and generates a signal that is injected into the speaker (or other transducer) output to cancel ambient acoustic events. A reference microphone is provided to measure the ambient acoustic environment, and an error microphone is included to measure the ambient audio and transducer output at the transducer, thus giving an indication of the effectiveness of the noise cancellation. A secondary path estimating adaptive filter is used to remove the playback audio from the error microphone signal, in order to generate an error signal. However, depending on the presence (and level) of the audio signal reproduced by the personal audio device, e.g., downlink audio during a telephone conversation or playback audio from a media file/connection, the secondary path adaptive filter may not be able to continue to adapt to estimate the secondary path response.

Further, at the beginning of a telephone conversation, not only may downlink audio be absent, but any previous secondary path model may be inaccurate due to a different position of the wireless telephone with respect to the user's ear. The techniques disclosed herein use ambient noise to provide enough energy for the secondary path estimating adaptive filter to continue to adapt, in a manner that is unobtrusive to the user. The anti-noise signal may be provided to the secondary path adaptive filter, in order to provide a training signal for adapting the secondary path response estimate. The error microphone signal is corrected to remove components due to ambient noise present at the error microphone, leaving only components due to the anti-noise signal. The components due to ambient noise are removed using a primary path response modeling adaptive filter that has been previously adapted to model the primary path response.

Figure 1:
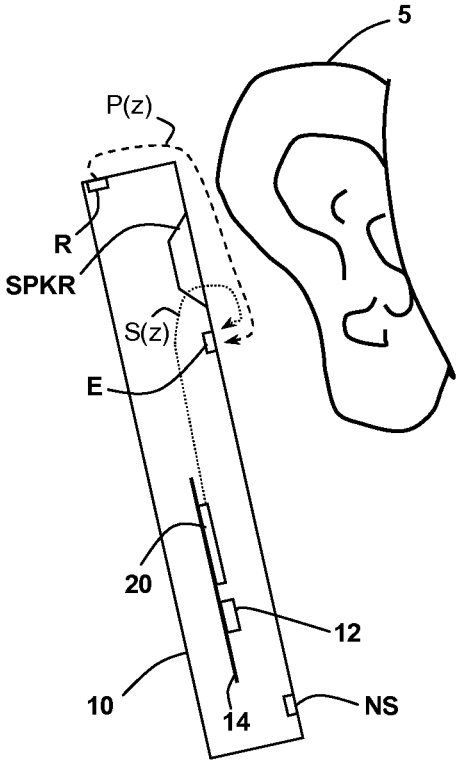
FIG. 1 is an illustration of an exemplary wireless telephone 10.

FIG. 1 shows an exemplary wireless telephone 10 in proximity to a human ear 5. Illustrated wireless telephone 10 is an example of a device in which techniques illustrated herein may be employed, but it is understood that not all of the elements or configurations embodied in illustrated wireless telephone 10, or in the circuits depicted in subsequent illustrations, are required. Wireless telephone 10 includes a transducer such as a speaker SPKR that reproduces distant speech received by wireless telephone 10, along with other local audio events such as ringtones, stored audio program material, near-end speech, sources from web-pages or other network communications received by wireless telephone 10 and audio indications such as battery low and other system event notifications. A near speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment and is positioned away from the typical position of a user's mouth, so that the near-end speech is minimized in the signal produced by reference microphone R. A third microphone, error microphone E, is provided in order to further improve the ANC operation by providing a measure of the ambient audio combined with the audio reproduced by speaker SPKR close to ear 5, when wireless telephone 10 is in close proximity to ear 5. An exemplary circuit 14 within wireless telephone 10 includes an audio CODEC integrated circuit 20 that receives the signals from reference microphone R, near speech microphone NS, and error microphone E and interfaces with other integrated circuits such as an RF integrated circuit 12 containing the wireless telephone transceiver. In other implementations, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques disclosed herein measure ambient acoustic events (as opposed to the output of speaker SPKR and/or the near-end speech) impinging on reference microphone R, and also measure the same ambient acoustic events impinging on error microphone E. The ANC processing circuits of illustrated wireless telephone 10 adapt an anti-noise signal generated from the output of reference microphone R to have a characteristic that minimizes the amplitude of the ambient acoustic events present at error microphone E. Since acoustic path P(z) extends from reference microphone R to error microphone E, the ANC circuits are essentially estimating acoustic path P(z) combined with removing effects of an electro-acoustic path S(z). Electro-acoustic path S(z) represents the response of the audio output circuits of CODEC IC 20 and the acoustic/electric transfer function of speaker SPKR including the coupling between speaker SPKR and error microphone E in the particular acoustic environment. Path S(z) is affected by the proximity and structure of ear 5 and other physical objects and human head structures that may be in proximity to wireless telephone 10, when wireless telephone 10 is not firmly pressed to ear 5. While the illustrated wireless telephone 10 includes a two microphone ANC system with a third near speech microphone NS, other systems that do not include separate error and reference microphones can implement the above-described techniques. Alternatively, near speech microphone NS can be used to perform the function of the reference microphone R in the above-described system. Finally, in personal audio devices designed only for audio playback, near speech microphone NS will generally not be included, and the near speech signal paths in the circuits described in further detail below can be omitted.

Figure 2:
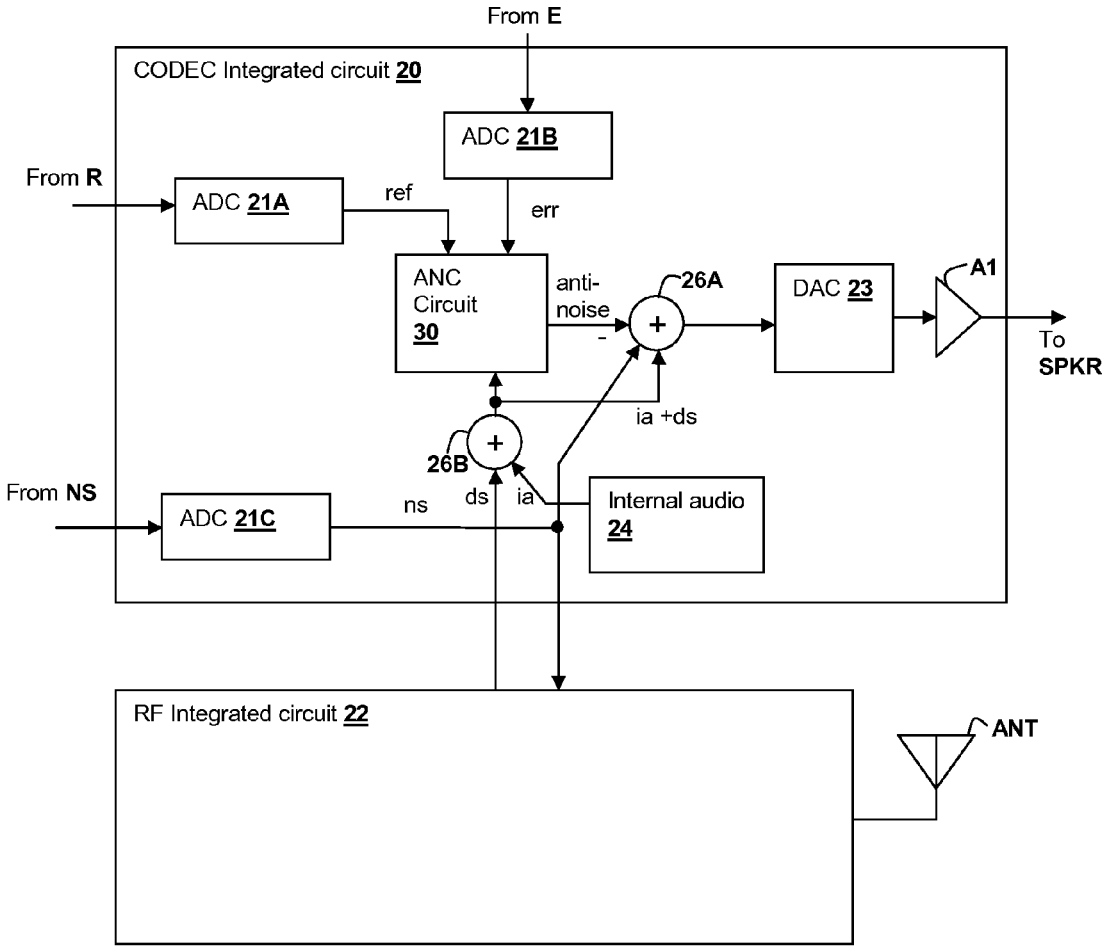
FIG. 2 is a block diagram of circuits within wireless telephone 10.

Referring now to FIG. 2, circuits within wireless telephone 10 are shown in a block diagram. CODEC integrated circuit 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation of near speech microphone signal ns. CODEC IC 20 generates an output for driving speaker SPKR from an amplifier A1, which amplifies the output of a digital-to-analog converter (DAC) 23 that receives the output of a combiner 26A. Another combiner 26B combines audio signals is from internal audio sources 24 and downlink speech ds received from a radio frequency (RF) integrated circuit 22 to form source audio signal (ds+ia), which is provided to combiner 26A and to an ANC circuit 30. Combiner 26A combines source audio signal (ds+ia) with the anti-noise signal provided from ANC circuit 30 and a portion of near speech signal ns. Near speech signal ns is also provided to RF integrated circuit 22 and is transmitted as uplink speech to the service provider via an antenna ANT. Anti-noise signal anti-noise by convention has the same polarity as the noise in reference microphone signal ref and is therefore subtracted by combiner 26A.

Figure 3:
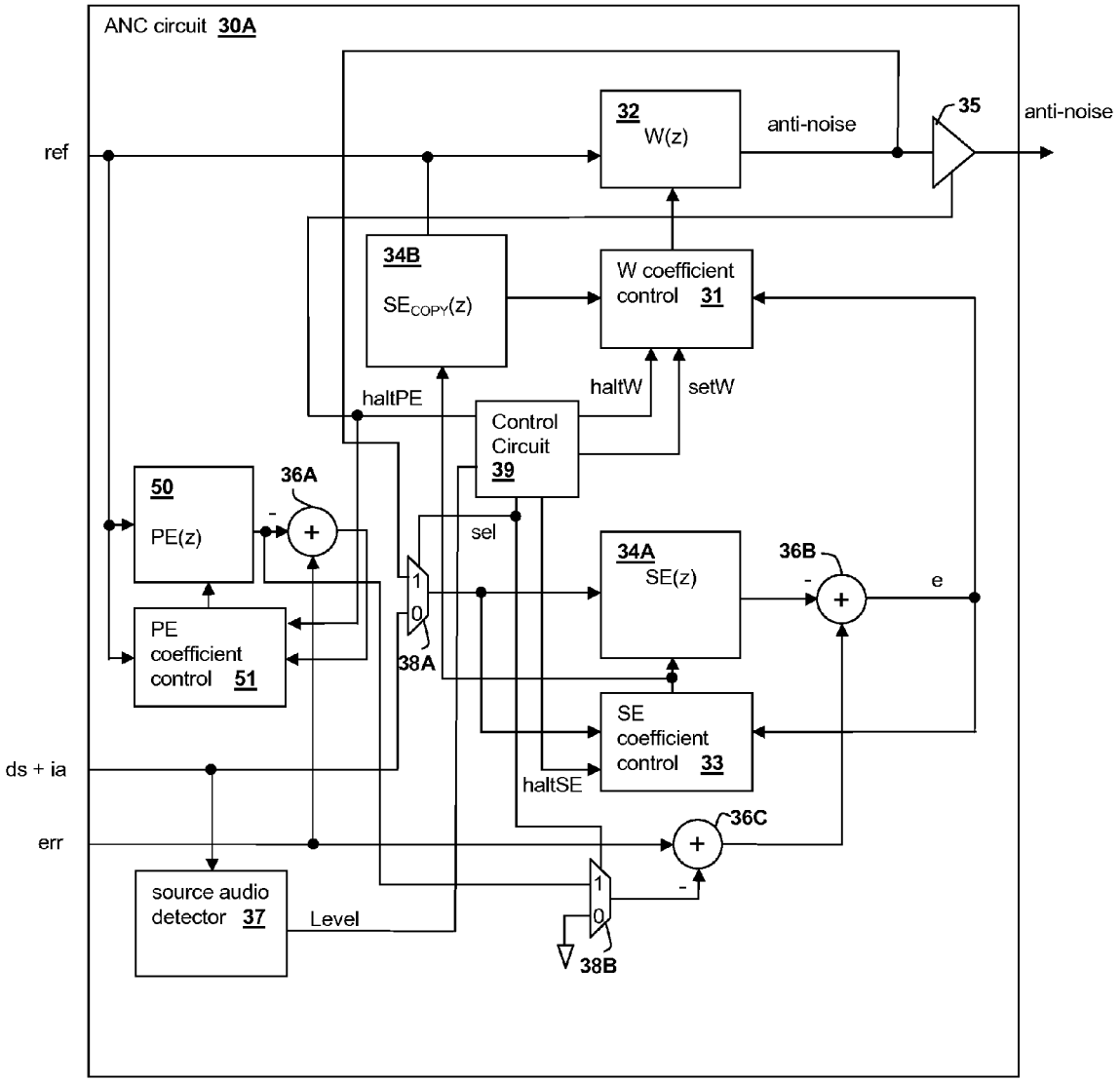
FIG. 3 is a block diagram depicting signal processing circuits and functional blocks of various exemplary ANC circuits that can be used to implement ANC circuit 30 of CODEC integrated circuit 20 of FIG. 2.

FIG. 3 shows one example of details of an ANC circuit 30A that can be used to implement ANC circuit 30 of FIG. 2. A pair of selectors 38A-38B are controlled by a control signal sel provided from a control circuit 39. Selectors 38A-38B select between two operating modes: a normal mode, selected when control signal sel is de-asserted (sel=0) and an ambient noise-based SE training mode selected when control signal sel is asserted (sel=1). The ambient noise is selectively provided to train response SE(z) when control signal sel is asserted (sel=1). In the normal operating mode (sel=0), an adaptive filter 32 receives reference microphone signal ref and under ideal circumstances, adapts its transfer function W(z) to be P(z)/S(z) to generate the anti-noise signal anti-noise, which is provided to an output combiner that combines the anti-noise signal with the audio to be reproduced by the transducer, as exemplified by combiner 26A of FIG. 2. The coefficients of adaptive filter 32 are controlled by a W coefficient control block 31 that uses a correlation of two signals to determine the response of adaptive filter 32, which generally minimizes the error, in a least-mean squares sense, between those components of reference microphone signal ref present in error microphone signal err. The signals processed by W coefficient control block 31 are the reference microphone signal ref as shaped by a copy of an estimate of the response of path S(z) provided by a filter 34B and another signal that includes error microphone signal err. By transforming reference microphone signal ref with a copy of the estimate of the response of path S(z), response $SE_{COPY}(z)$, and minimizing error microphone signal err after removing components of error microphone signal err due to playback of source audio, adaptive filter 32 adapts to the desired response of P(z)/S(z). In addition to error microphone signal err, the other signal processed along with the output of filter 34B by W coefficient control block 31 includes an inverted amount of the source audio including downlink audio signal ds and internal audio ia that has been processed by filter response SE(z), of which response $SE_{COPY}(z)$ is a copy. By injecting an inverted amount of source audio, adaptive filter 32 is prevented from adapting to the relatively large amount of source audio present in error microphone signal err and by transforming the inverted copy of downlink audio signal ds and internal audio ia with the estimate of the response of path S(z), the source audio that is removed from error microphone signal err before processing should match the expected version of downlink audio signal ds, and internal audio ia reproduced at error microphone signal err, since the electrical and acoustical path of S(z) is the path taken by downlink audio signal ds and internal audio ia to arrive at error microphone E. Filter 34B is not an adaptive filter, per se, but has an adjustable response that is tuned to match the response of a secondary path adaptive filter 34A, so that the response of filter 34B tracks the adapting of secondary path adaptive filter 34A.

To implement the above, secondary path adaptive filter 34A has coefficients controlled by a SE coefficient control block 33, which processes the source audio (ds+ia) and error microphone signal err after removal, by a combiner 36B, of the above-described filtered downlink audio signal ds and internal audio ia, that has been filtered by secondary path adaptive filter 34A to represent the expected source audio delivered to error microphone E. Secondary path adaptive filter 34A is thereby adapted to generate an error signal e from downlink audio signal ds and internal audio ia, that when subtracted from error microphone signal err, contains the content of error microphone signal err that is not due to source audio (ds+ia). However, if downlink audio signal ds and internal audio ia are both absent, e.g., at the beginning of a telephone call, or have very low amplitude, SE coefficient control block 33 will not have sufficient input to estimate acoustic path S(z). Therefore, in ANC circuit 30A, when source audio has not been present, the secondary path estimate is updated by using the ambient noise-based SE training mode mentioned above, which uses ambient noise measured by reference microphone R as a training signal for updating response SE(z) of secondary path adaptive filter 34A.

When SE coefficient control 33 needs to be updated, e.g., at the start of a telephone conversation, and a source audio detector 37 indicates that source audio (ds+ia) has insufficient amplitude for training the secondary path response SE(z), control circuit 39 asserts control signal sel to select the ambient noise-based training mode. In order to provide a copy of the ambient noise training signal referenced at the location of error microphone E, an adaptive filter 50 is used to model acoustic path P(z). During an initial training phase with ANC turned off, which is accomplished by de-activating (muting) a controllable amplifier stage 35 in response to de-assertion of a control signal haltPE, adaptive filter models path P(z) by filtering reference microphone signal ref with adaptive filter 50 and subtracting the output of adaptive filter 50 from error microphone signal err using a combiner 36A. Control signal haltSE is also asserted to prevent adaptation of secondary path response SE(z) during adaptation of the primary path response PE(z) of adaptive filter 50. The output of combiner 36A is compared with reference microphone signal err in a PE coefficient control block 51 which is generally a least-mean-squared (LMS) control block, which causes adaptive filter 50 to adapt primary path response PE(z) to match acoustic path P(z). After primary path response PE(z) is adapted, control signal haltPE is asserted, causing PE coefficient control block to maintain primary path response PE(z) at its current value. Subsequently, adaptive filter 50 filters reference microphone signal ref to provide an output that is representative of the ambient noise component of error microphone signal err. Control signal setW is also set to cause coefficient control block 31 to set the response of adaptive filter 32 to a predetermined response for generating the ambient noise training signal, generally a response that should provide some noise cancelling effect while response SE(z) of adaptive filter 34 is being trained, since the ambient noise training signal will be audible as the anti-noise signal anti-noise while secondary path adaptive filter 32 is being adapted. A combiner 36C is used in the ambient noise-based SE training mode (sel=1) to subtract the output of adaptive filter 50 from error microphone signal err. Combiner 36C thus effectively removes the ambient noise component from error microphone signal err, so that error signal e will contain only a component due to anti-noise signal anti-noise, since source audio (ds+ia) is absent or very low in amplitude. During this time, anti-noise signal anti-noise is provided to the input of adaptive filter 34A via selector 38A and control signal haltSE is de-asserted so that SE coefficient control block 33 is allowed to update coefficients to train response SE(z). Once response SE(z) is adapted, control signal sel is de-asserted and control signals haltW and setW are also de-asserted to allow response W(z) to adapt by updating coefficient control block 31.

Figure 4:
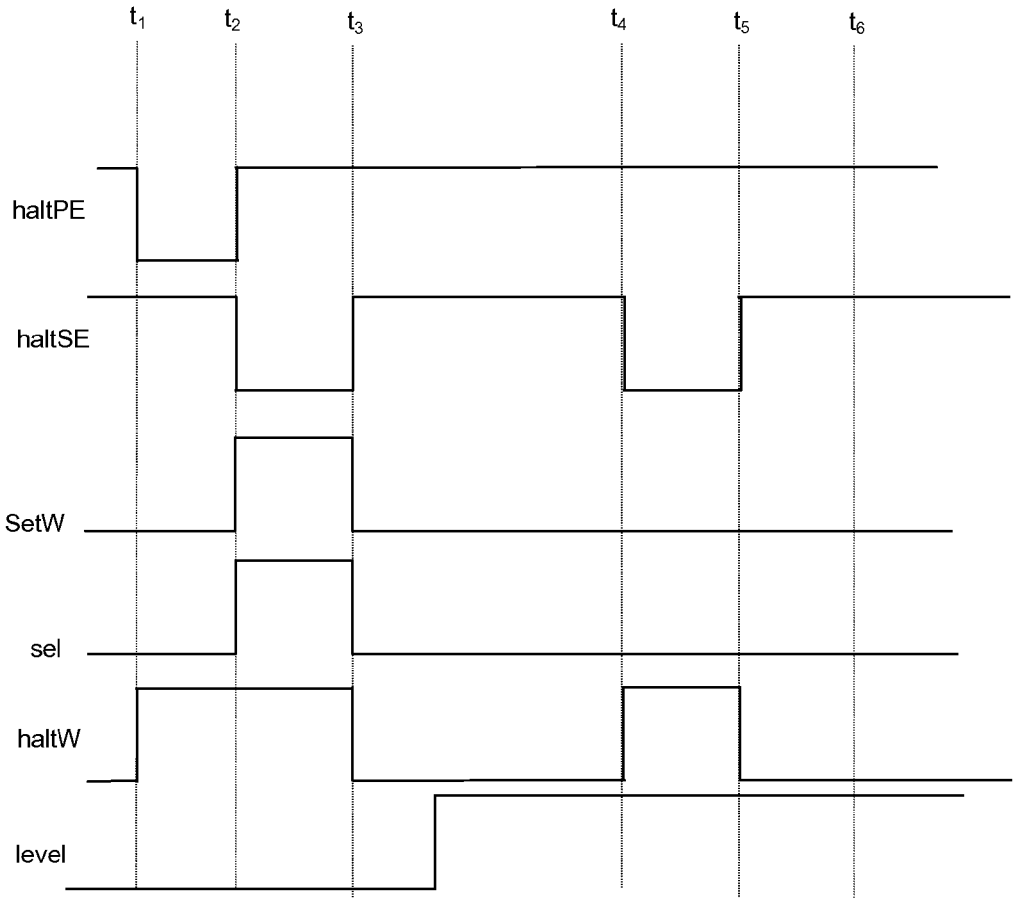
FIG. 4 is a timing diagram illustrating operation of ANC circuit 30.

Referring now to FIG. 4, a sequence for training SE both with and without source audio (ds+ia) is shown, as can be performed within ANC circuit 30A of FIG. 3. At time $t_1$, signal level is low, indicating that insufficient source audio (ds+ia) is present for adapting response SE(z). Between times $t_1$ and $t_2$, control signal haltPE is de-asserted, which causes primary path response PE(z) of adaptive filter 50 to model path P(z). Next, between times $t_2$ and $t_3$, control signal SetW is asserted to set response W(z) to a predetermined value. Once adaptive filter 50 has adapted at time $t_2$, control signal haltPE is asserted to maintain the response of adaptive filter 50 at its current value, and control signal haltSE is de-asserted to allow response SE(z) to adapt. Control signal SetW remains asserted to provide a predetermined response for adaptive filter 32 while adaptive filter 34A is adapting. During the interval between times $t_2$ and $t_3$, secondary path adaptive filter 34A trains its response to the ambient noise received by reference microphone signal R transformed by response W(z), which has been set to a predetermined response (or a bypass flat response) in response to assertion of control signal setW. As in the normal mode, the output of secondary path adaptive filter 34A is subtracted from error microphone signal err to provide an input to SE coefficient control 33 and response SE(z) adapts to model S(z), just as when downlink audio is available. At time $t_3$, control signals setW and haltW are de-asserted, to permit response W(z) of adaptive filter 32 to adapt. At time $t_4$, another training of response SE(z) is commenced, which could be due to another call being initiated, a detected change in the response of SE(z), a change in ear pressure, instability, etc. Signal level is in an asserted state, indicating that sufficient source audio (ds+ia) is present, and so the cycle from times $t_1$ and $t_3$ is not repeated, but rather, response SE(z) will be training in the normal operating mode using source audio (ds+ia). Between times $t_4$ and $t_5$, control signal haltSE is de-asserted and control signal haltW is asserted, permitting response SE(z) of adaptive filter 34A to adapt, and then between times $t_5$ and $t_6$, control signal haltSE is asserted and control signal haltW is de-asserted, permitting response W(z) of adaptive filter 32 to adapt. However, in the normal operating mode, adapting of adaptive filter 34A and adaptive filter 32 can be carried out simultaneously or in any other suitable manner.

Figure 5:
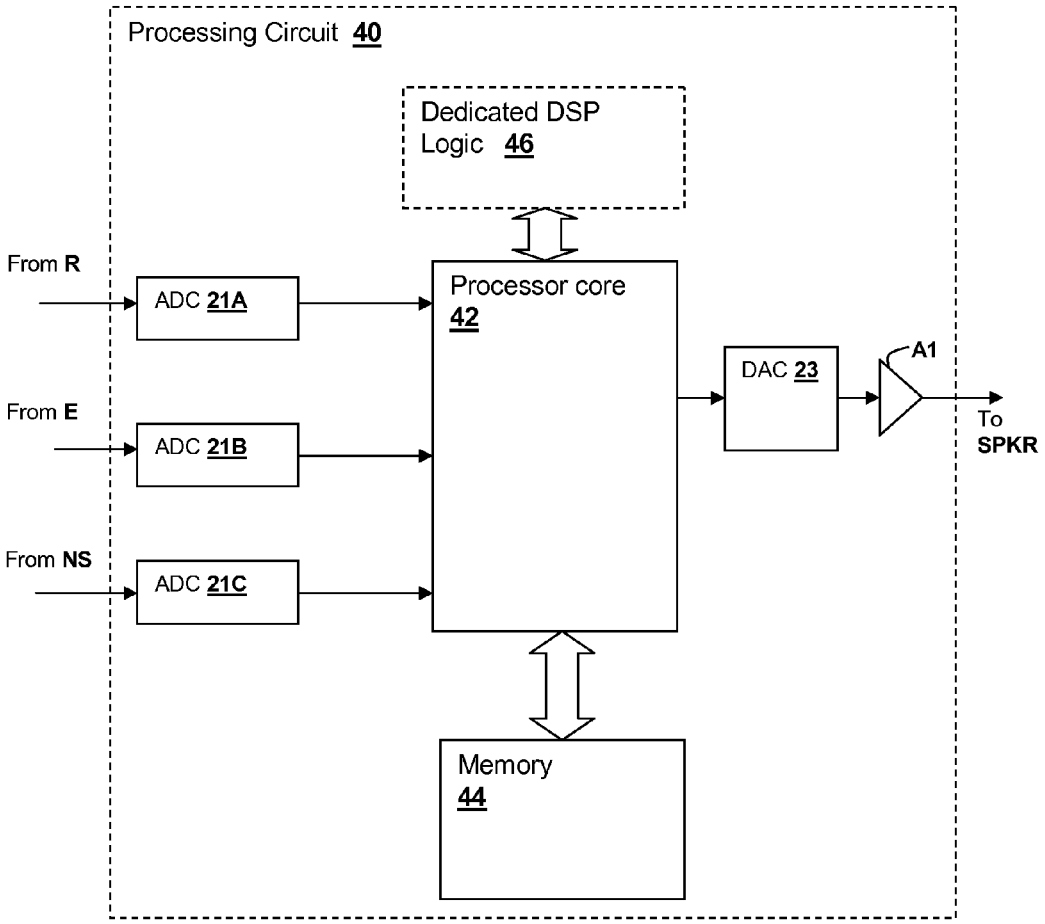
FIG. 5 is a block diagram depicting signal processing circuits and functional blocks within CODEC integrated circuit 20

Referring now to FIG. 5, a block diagram of an ANC system is shown for implementing ANC techniques as depicted in FIG. 3, and having a processing circuit 40 as may be implemented within CODEC integrated circuit 20 of FIG. 2. Processing circuit 40 includes a processor core 42 coupled to a memory 44 in which are stored program instructions comprising a computer-program product that may implement some or all of the above-described ANC techniques, as well as other signal processing. Optionally, a dedicated digital signal processing (DSP) logic 46 may be provided to implement a portion of, or alternatively all of, the ANC signal processing provided by processing circuit 40. Processing circuit 40 also includes ADCs 21A-21C, for receiving inputs from reference microphone R, error microphone E and near speech microphone NS, respectively. DAC 23 and amplifier A1 are also provided by processing circuit 40 for providing the transducer output signal, including anti-noise as described above.

While the invention has been particularly shown and described with reference to the preferred embodiments thereof, it will be understood by those skilled in the art that the foregoing, as well as other changes in form and details may be made therein without departing from the spirit and scope of the invention.

What is claimed:

1. A personal audio device, comprising:

a personal audio device housing;

a transducer mounted on the housing for reproducing an audio signal including both source audio for playback to a listener and an anti-noise signal for countering the effects of ambient audio sounds in an acoustic output of the transducer;

a reference microphone mounted on the housing for providing a reference microphone signal indicative of the ambient audio sounds;

an error microphone mounted on the housing in proximity to the transducer for providing an error microphone signal indicative of the acoustic output of the transducer and the ambient audio sounds at the transducer; and a processing circuit that generates the anti-noise signal from the reference signal by adapting a first adaptive filter to reduce the presence of the ambient audio sounds heard by the listener in conformity with an error signal and the reference microphone signal, wherein the processing circuit implements a secondary path adaptive filter having a secondary path response controlled by a secondary path coefficient control circuit in conformity with the error signal, wherein the secondary path adaptive filter shapes the source audio with the secondary path response, wherein the processing circuit removes the source audio as shaped by the secondary path response from the error microphone signal to provide the error signal, wherein the processing circuit provides an ambient noise training signal generated from the reference microphone signal to the secondary path adaptive filter to adapt the secondary path response.

2. The personal audio device of claim 1, wherein the processing circuit detects an amplitude of the source audio, and selectively provides the ambient noise training signal to the secondary path adaptive filter in response to detecting that the amplitude of the source audio is below a threshold value.

3. The personal audio device of claim 1, wherein the processing circuit sets a response of the first adaptive filter to a predetermined response to generate the ambient noise training signal from the reference microphone signal.

4. The personal audio device of claim 1, wherein the processing circuit further implements a primary path modeling adaptive filter having a primary path response, and wherein the processing circuit applies the primary path response to the reference microphone signal and subtracts a result of applying the primary path response to the reference microphone signal from the error microphone signal to generate the error signal.

5. The personal audio device of claim 4, wherein the processing circuit sequences adaptation of the secondary path response and the primary path response so that the primary path response is adapted while the secondary path response is held at a fixed value, and then the secondary path response is adapted after the primary path response has adapted.

6. The personal audio device of claim 5, wherein the processing circuit mutes the anti-noise signal while the primary path response is adapted.

7. The personal audio device of claim 6, wherein the processing circuit sets a response of the first adaptive filter to a predetermined response while the ambient noise training signal is provided to the secondary path adaptive filter and the secondary path response is adapted.

8. The personal audio device of claim 7, wherein the processing circuit adapts the response of the first adaptive filter after the secondary path response is adapted.

9. A method of countering effects of ambient audio sounds by a personal audio device, the method comprising:

adaptively generating an anti-noise signal from a reference microphone signal by adapting a first adaptive filter to reduce the presence of the ambient audio sounds heard by the listener in conformity with an error signal and a reference microphone signal;

combining the anti-noise signal with source audio;

providing a result of the combining to a transducer;

measuring an acoustic output of the transducer and the ambient audio sounds with an error microphone;

implementing a secondary path adaptive filter having a secondary path response controlled by a secondary path coefficient control circuit in conformity with the error signal;

shaping the source audio with the secondary path response;

removing the source audio as shaped by the secondary path response from the error microphone signal to provide the error signal;

generating an ambient noise training signal from the reference microphone signal; and selectively providing the ambient noise training signal to the secondary path adaptive filter to adapt the secondary path response.

10. The method of claim 9, further comprising detecting an amplitude of the source audio, and wherein the selectively providing the ambient noise training to the secondary path adaptive filter provides the ambient noise training signal to the secondary path adaptive filter in response to detecting that the amplitude of the source audio is below a threshold value.

11. The method of claim 9, further comprising setting a response of the first adaptive filter to a predetermined response to generate the ambient noise training signal.

12. The method of claim 9, further comprising:

modeling a primary path response with a primary path modeling adaptive filter;

applying the primary path response to the reference microphone signal; and subtracting a result of the applying the primary path response to the reference microphone signal from the error microphone signal to generate the error signal.

13. The method of claim 12, further comprising sequencing adaptation of the secondary path response and the primary path response so that the primary path response is adapted while the secondary path response is held at a fixed value, and then the secondary path response is adapted after the primary path response has adapted.

14. The method of claim 13, further comprising muting the anti-noise signal while the primary path response is adapted.

15. The method of claim 14, further comprising setting a response of the first adaptive filter to a predetermined response while the ambient noise training signal is provided to the secondary path adaptive filter and the secondary path response is adapted.

16. The method of claim 15, wherein the adaptively generating adapts the response of the first adaptive filter after the secondary path response is adapted.

17. An integrated circuit for implementing at least a portion of a personal audio device, comprising:

an output for providing an output signal to an output transducer including both source audio for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the acoustic output of the transducer and the ambient audio sounds at the transducer;

a noise source for providing a noise signal; and a processing circuit that generates the anti-noise signal from the reference signal by adapting a first adaptive filter to reduce the presence of the ambient audio sounds heard by the listener in conformity with an error signal and the reference microphone signal, wherein the processing circuit implements a secondary path adaptive filter having a secondary path response controlled by a secondary path coefficient control circuit in conformity with the error signal, wherein the secondary path adaptive filter shapes the source audio with the secondary path response, wherein the processing circuit removes the source audio as shaped by the secondary path response from the error microphone signal to provide the error signal, wherein the processing circuit provides an ambient noise training signal generated from the reference microphone signal to the secondary path adaptive filter to adapt the secondary path response.

18. The integrated circuit of claim 17, wherein the processing circuit detects an amplitude of the source audio, and selectively provides the ambient noise training signal to the secondary path adaptive filter in response to detecting that the amplitude of the source audio is below a threshold value.

19. The integrated circuit of claim 17, wherein the processing circuit sets a response of the first adaptive filter to a predetermined response to generate the ambient noise training signal from the reference microphone signal.

20. The integrated circuit of claim 17, wherein the processing circuit further implements a primary path modeling adaptive filter having a primary path response, and wherein the processing circuit applies the primary path response to the reference microphone signal and subtracts a result of applying the primary path response to the reference microphone signal from the error microphone signal to generate the error signal.

21. The integrated circuit of claim 20, wherein the processing circuit sequences adaptation of the secondary path response and the primary path response so that the primary path response is adapted while the secondary path response is held at a fixed value, and then the secondary path response is adapted after the primary path response has adapted.

22. The integrated circuit of claim 21, wherein the processing circuit mutes the anti-noise signal while the primary path response is adapted.

23. The integrated circuit of claim 22, wherein the processing circuit sets a response of the first adaptive filter to a predetermined response while the ambient noise training signal is provided to the secondary path adaptive filter and the secondary path response is adapted.

24. The integrated circuit of claim 23, wherein the processing circuit adapts the response of the first adaptive filter after the secondary path response is adapted.

* * * * *